United States Patent [19]

Claesson et al.

[11] Patent Number: 4,855,554

[45] Date of Patent: Aug. 8, 1989

[54] ARRANGEMENT IN A MICROWAVE OVEN

[75] Inventors: Jan S. Claesson, Linköping; Per O. G. Risman, Herryda, both of Sweden

[73] Assignee: U.S. Philips Corporation, New York, N.Y.

[21] Appl. No.: 151,141

[22] Filed: Feb. 1, 1988

[30] Foreign Application Priority Data

Feb. 6, 1987 [SE] Sweden ..... 8700453

[51] Int. Cl.[4] ..... H05B 6/64

[52] U.S. Cl. ..... 219/10.55 F; 219/10.55 D

[58] Field of Search ..... 219/10.55 F, 10.55 R, 219/10.55 E, 10.55 D

[56] References Cited

U.S. PATENT DOCUMENTS

| | | | |
|---|---|---|---|
| 3,584,177 | 6/1971 | Bucksbaum | 219/10.55 D |
| 3,789,178 | 1/1974 | Harhen | 219/10.55 D |
| 4,144,437 | 3/1979 | Ehlers | 219/10.55 F |
| 4,390,768 | 6/1983 | Teich et al. | 219/10.55 D |
| 4,430,539 | 2/1984 | Suzuki | 219/10.55 F |

*Primary Examiner*—Philip H. Leung
*Attorney, Agent, or Firm*—Robert J. Kraus

[57] ABSTRACT

In certain types of microwave ovens, e.g. ovens of the single-wall type, the manufacturing of the oven cavity (10) involves the forming of at least one groove-shaped recess (16) in at least one of the cavity walls (14). In order to substantially eliminate the disturbing effect of this recess (16) on the microwave field pattern in the oven cavity (10), a reflecting element in the shape of an elongated strip (18) of conductive material is provided in a position at the entrance opening of the recess (16), as seen from the oven cavity (10). The conductive strip (18) is preferably covered by dielectric material, e.g. in the shape of a dielectric plate (20) that also serves as support for the strip (18), and this strip (18) is so dimensioned and disposed at the opening of the recess (16) that it substantially reflects all incident microwave radiation coming from the oven cavity (10) at the operational frequency of the microwave oven.

6 Claims, 2 Drawing Sheets

ARRANGEMENT IN A MICROWAVE OVEN

BACKGROUND OF THE INVENTION

The invention relates to an arrangement in a microwave oven that comprises an oven cavity bounded by a plurality of conductive walls, a reclosable oven door giving access to the oven cavity and a microwave source mounted external of the oven cavity for feeding microwave energy into the interior of the oven cavity.

Normally, the oven cavity is a rectangular parallelepiped that has a highly symmetrical shape. However, in certain types of microwave ovens the shape of the oven cavity must have a certain degree of unsymmetry for reasons of manufacturing. This applies for instance to ovens of the "single-wall" type, in which at least one cavity wall also forms a part of the outer envelope wall of the oven. At the front of such an oven, the wall common to cavity and outer envelope must be bent for producing an access section cooperating with the oven door to provide a microwave seal, and also for producing a front having a sufficient mechanical stability. In this bent wall portion, an elongated groove-shaped recess will be formed that has an open side facing the oven cavity and that leads to an unsymmetry of the microwave field in the oven cavity, which unsymmetry is attributable to the fact that such a recess will involve a discontinuity of the microwave field boundary constituted by the oven cavity wall. Such groove-shaped recesses will aggravate the object of achieving a good microwave field distribution and thereby a uniform heating of the load in the oven cavity, in particular because the geometry and the size of the load will vary.

SUMMARY OF THE INVENTION

More especially, the invention relates to a microwave oven having an oven cavity, at the manufacturing of which such groove-shaped recesses leading to unsymmetries of the microwave field have been formed in at least one of the cavity walls, and it is an object of the invention to substantially eliminate the influence of these recesses on the microwave field in a simple manner so that the oven cavity, as regards its microwave aspects, operates as a space having a highly symmetrical shape.

According to the invention, this object is achieved in that reflecting elements of conductive material are provided at the open side of the recesses facing the oven cavity, the reflecting elements covering a part of the open recess side and being dimensioned and disposed so as to substantially reflect all incident radiation at the operational frequency of the microwave oven.

By applying these measures the influence of the recesses on the microwave field will be substantially eliminated in a very simple manner without using a complete metallic covering of the recesses by means of conductive material, such a covering requiring an effective galvanic contact, made by seam-welding or the like, between the covering material and the cavity wall parts surrounding the recesses in order to avoid sparking.

Suitably, the reflecting element has the shape of a substantially plane conductive strip having an essentially rectangular form. The width and the length of this strip as well as its position in the recess will be decisive for its functioning in reflecting incident microwave energy, that is to say in adapting the actual shape of the oven cavity to the shape of a a space producing the best possible microwave field distribution and heating, which space has a highly symmetrical shape.

Suitably, the reflecting element, as seen from the cavity, is completely or partly covered by dielectric material, for example polypropylene. The dielectric material can be shaped as a plate covering the entrance opening of the recess and simultaneously supporting the reflecting element at its rear side. The dimensioning of the reflecting element in the shape of a conductive strip for achieving the desired function will then be influenced by the dielectric properties of the plate and also by the presence of an air gap, if any, between the plate and the element. Such a dielectric plate will also serve as protection against dirt which could penetrate into the recess.

In one embodiment of the reflecting element in the shape of a rectangular conductive strip, this strip has bent longer side portions so that the element will have a substantially U-shaped cross section.

Preferably, the reflecting element has no galvanic contact with the oven cavity walls.

BRIEF DESCRIPTION OF THE DRAWING

The invention will now be illustrated, by way of non-limitative example, with reference to the accompanying drawings, in which.

DESCRIPTION OF THE PREFERRED EMBODIMENTS

Figure 1:
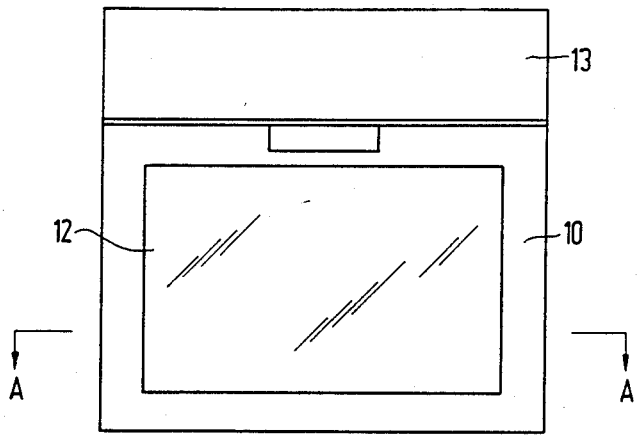
FIG. 1 shows a simplified front view of a microwave oven of the "single-wall" type.
Figure 2:
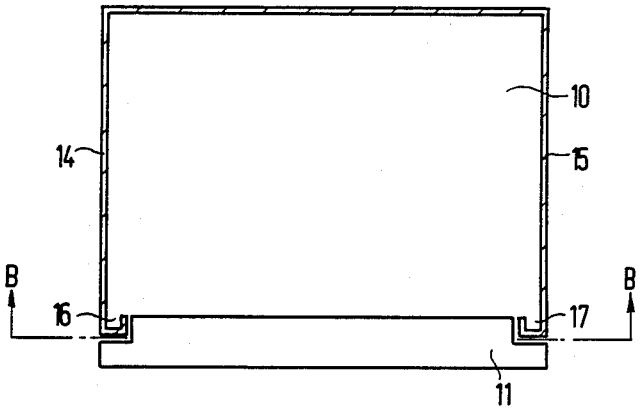
FIG. 2 shows a sectional view of the same oven along the line A—A in FIG. 1.

In FIGS. 1 and 2 reference numeral 10 designates a microwave oven cavity, reference numeral 11 designates a door for closing an opening giving access to the cavity, reference numeral 12 designates a window in the door 11 and reference numeral 13 designates an operation and control unit comprising all electrical components that are necessary for the operation of the oven.

The microwave oven is of the "single-wall" type and in particular the side walls 14, 15 of the oven cavity 10 also form a part of the outer envelope of the oven. The oven cavity 10 is manufactured by bending a metallic sheet. At this bending process, the oven front, which is adapted to cooperate with the door 11, is made as an integral constituent part of the cavity walls 14, 15 and is formed by bent portions of these walls. Elongated recesses or grooves 16 and 17, which are open towards the interior of the oven cavity, will then be formed at the oven front on each side of the access opening. These recesses involve an unsymmetry in the shape of the oven cavity and will disturb the microwave field pattern in this oven cavity.

Figure 3:
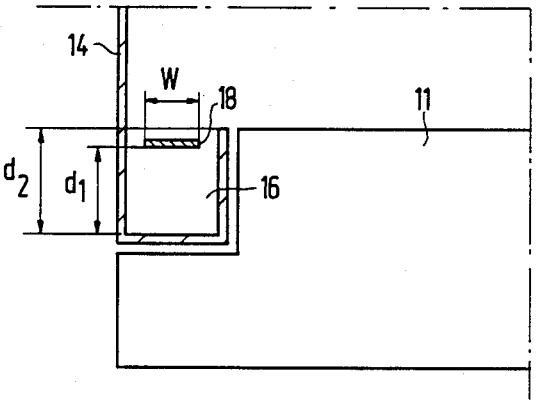
FIG. 3 shows a partial enlargement of the sectional view in FIG. 2 with a matching or reflecting element according to the invention introduced into a groove-shaped of the oven cavity wall at the oven front.
Figure 4:
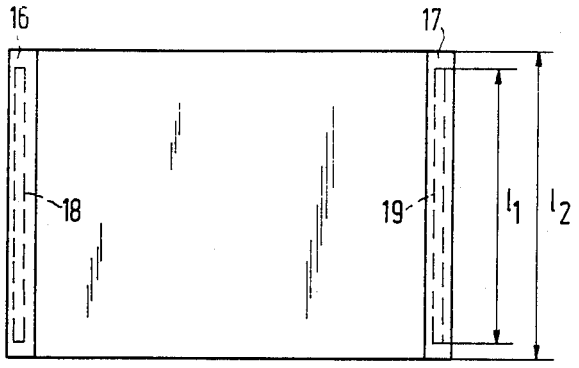
FIG. 4 shows a sectional view along the line B—B in FIG. 2.

As is apparent from FIGS. 3 and 4, elongated matching or reflecting elements 18, 19 of metallic conductive material are arranged in accordance with the invention in a position that substantially coincides with the entrance opening of the recesses. In the example shown, the reflecting elements are in the shape of rectanfular strips that have a given length $l_1$ related to the length $l_2$ of the recess and a given width w, and that are disposed at a given distance $d_1$ from the bottom of the recess related to the overall depth $d_2$ of the recess. These parameters are accurately determined, partly empirically, in such a manner that the elements 18, 19 serve as total reflectors for incident microwave radiation coming from the oven cavity at the operational frequency of the microwave oven. The reflecting elements have no galvanic contact with the cavity walls.

Figure 5:
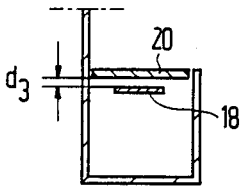
FIG. 5 shows an embodiment in which the reflecting element is supported by a dielectric plate.

According to FIG. 5, the entrance of the recess is covered by a dielectric plate 20 that at the same time serves as support for the reflecting element 18. If desired, there can be a small distance $d_3$ between the plate 20 and the element 18. This air gap $d_3$ has also an influence on the optimal dimensioning of the reflecting element 18.

By way of example, the data will be given that result from one dimensioning of plane rectangular reflecting elements for recesses at the front of a "single-wall" type of microwave oven operating at the typical microwave frequency of 2,450 MHz:

$l_2 = 210$ mm
$l_1 = 187$ mm
$w = 8$ mm
$d_1 = 18$ mm
$d_2 = 20$ mm
$d_3 = 1$ mm

Figure 6A:
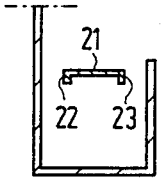
FIGS. 6*a*, 6*b* and 6*c* shows alternative embodiments of the reflecting element.
Figure 6B:
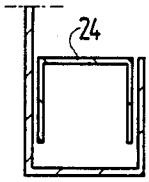
Figure 6C:
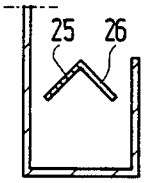

Another embodiment of the reflecting element is shown in FIG. 6*a*, where the reflecting element consists of a plane part 21 and two bent side portions 22, 23. These portions can, for example, have a height of 2 mm. A variant of this embodiment in which the reflecting element 24 almost fills the whole recess, is shown in FIG. 6*b*. A further embodiment of the reflecting element is shown in FIG. 6*c*, where the element consists of two oblique conductive strips 25, 26 so that it will have a V-shaped cross section.

The ends of the reflecting element may be shaped in various ways, e.g. these ends may be rounded in order to minimize the risk of sparking. In case a plate of dielectric material covers the reflecting element, the dielectric properties of this plate can be selected in such a manner that the element, at an optimal dimensioning, will have a length and width that minimize the risk of sparking between the element and adjacent metal wall surfaces. Such a dimensioning of the reflecting element, providing a sufficiently wide gap between the element and adjacent cavity walls, is also important from the viewpoint of avoiding tolerance problems at the manufacturing and assembling. The reflecting element does not need to be vertical, e.g. in order to achieve adaption to the load that is always placed near the bottom of the oven cavity.

What is claimed is:

1. An arrangement in a microwave oven comprising an oven cavity bounded by a plurality of conductive walls, a microwave source mounted external of the oven cavity for feeding microwave energy into the interior of the oven cavity, at least one of said conductive cavity walls having a groove-shaped recess that has an open side facing the oven cavity and that disturbs the microwave field pattern in the interior of the oven cavity, the arrangement further comprising reflecting means of conductive material supported with no galvanic contact with said cavity walls at the open side of the recess facing the oven cavity, said reflecting means covering a portion of the open recess side and being dimensioned and positioned so as to substantially reflect all incident radiation from the oven cavity away from said recess and back into the oven cavity at the operational frequency of the microwave oven, and thereby substantially eliminating the effect of said recess on the microwave field.

2. An arrangement as claimed in claim 1, characterized in that the reflecting means is at least partly covered by dielectric material.

3. An arrangement as claimed in claim 2, characterized in that a plate of dielectric material completely covers the entrance opening to the recess, as seen from the oven cavity, and simultaneously supports the reflecting means.

4. An arrangement as claimed in claim 1, 2 or 3, characterized in that the reflecting means has the shape of a substantially plane conductive strip having an essentially rectangular form.

5. An arrangement as claimed in claim 4, characterized in that the conductive strip has bent longer side portions so that the strip has a substantially U-shaped cross section.

6. An arrangement as in claim 1, 2 or 3 where the microwave oven is of the single-wall type and has at least one cavity wall which also forms a part of an outer envelope of the oven, with groove-shaped recesses being formed by bent U-shaped portions of the cavity side walls at the oven front.

* * * * *